US008112832B2

(12) United States Patent
Hecker

(10) Patent No.: US 8,112,832 B2
(45) Date of Patent: Feb. 14, 2012

(54) ATTACHMENT OF A SANITARY WASHSTAND FITTING TO A WASHSTAND

(75) Inventor: Hans-Hermann Hecker, Oberboihingen (DE)

(73) Assignee: Hansa Metallwerke AG (DE)

( * ) Notice: Subject to any disclaimer, the term of this patent is extended or adjusted under 35 U.S.C. 154(b) by 1339 days.

(21) Appl. No.: 11/665,389

(22) PCT Filed: Oct. 8, 2005

(86) PCT No.: PCT/EP2005/010859

§ 371 (c)(1),
(2), (4) Date: Apr. 12, 2007

(87) PCT Pub. No.: WO2006/040102

PCT Pub. Date: Apr. 20, 2006

(65) Prior Publication Data

US 2007/0261167 A1 Nov. 15, 2007

(30) Foreign Application Priority Data

Oct. 13, 2004 (DE) ..... 10 2004 049 736

(51) Int. Cl.
*E03C 1/04* (2006.01)

(52) U.S. Cl. ..... 4/675; 4/678; 4/695

(58) Field of Classification Search ..... 4/675–678, 4/695; 137/315.12
See application file for complete search history.

(56) References Cited

U.S. PATENT DOCUMENTS

| | | | |
|---|---|---|---|
| 5,681,060 | A | 10/1997 | Berg et al. |
| 6,328,059 | B1 | 12/2001 | Testori et al. |
| 2002/0079701 | A1 | 6/2002 | Lehner |

FOREIGN PATENT DOCUMENTS

| | | | |
|---|---|---|---|
| DE | 1 787 594 | U | 4/1959 |
| DE | 295 16 157 | U1 | 4/1997 |
| EP | 0 765 974 | A1 | 4/1997 |
| EP | 1 357 233 | A1 | 10/2003 |
| JP | 10-317439 | A1 | 12/1998 |

*Primary Examiner* — Tuan Nguyen
(74) *Attorney, Agent, or Firm* — Factor Intellectual Property Law Group, Ltd.

(57) ABSTRACT

The invention relates to a sanitary washstand fitting, comprising a housing which is detachably secured to a washstand with the aid of a fixing device. The fixing device comprises a base which can be fixed to the washstand, an insertion device enabling the housing to be placed on the base from the top, and a clamping device enabling the housing thus arranged to be clamped against the base. The clamping device comprises a spring ring which is received in a groove of the base and which is radially expandable by means of a threaded pin such that it can also be engaged in a complementary counter groove in the housing.

8 Claims, 6 Drawing Sheets

ATTACHMENT OF A SANITARY WASHSTAND FITTING TO A WASHSTAND

RELATED APPLICATIONS

This application claims the filing benefit of PCT Patent Application No. PCT/EP2005/010859, filed Oct. 8, 2005, which claims the filing benefit of German Patent Application No. 102004049736.2 filed Oct. 13, 2004, the contents of which are incorporated herein by reference.

TECHNICAL FIELD

The invention relates to a sanitary washstand fitting having a housing which is detachably fastened to a washstand with the aid of a fastening arrangement.

BACKGROUND OF THE INVENTION

Fastening elements of known sanitary washstand fittings can be inserted in an aperture in a washstand from above and are secured from below by screwing. Often, the washstand is accessible from below only with difficulty, so that the fitter is frequently obliged to adopt an uncomfortable posture which is also detrimental to health. In addition, the connection of the washstand fitting from below by screwing is complicated and time-consuming.

The present invention is directed to resolving these and other matters.

SUMMARY OF THE INVENTION

The object of the present invention is to develop a sanitary washstand fitting of the initially mentioned type in such a way that it can be mounted, substantially from above, on a washstand in a stable manner without major technical resources.

This object is achieved, according to the invention, through the fact that the fastening arrangement comprises:

a) a base which can be fastened to the washstand;

b) a slip-on arrangement by means of which the housing can be slipped onto the base from above;

c) a clamping arrangement by means of which the housing which has been slipped on can be locked against the base.

According to the invention, therefore, the sanitary washstand fitting can be mounted on the washstand from above. For this purpose, the housing is slipped on from above and fixed to the pre-mounted base by means of the clamping arrangement, an operation which can be carried out rapidly and without any technical resources. All that is carried out underneath the washstand is the connection to the angle valves and the fitting of the pull rod to the waste fitting. The base thus forms an adapter for a large number of complementary housings of washstand fittings, which can be rapidly and easily substituted for one another.

It is particularly advantageous if the clamping arrangement comprises a clamping element which can be tensioned and untensioned, particularly above the washstand, by means of an adjusting element, so that the outlay in terms of labour is markedly reduced.

A particularly stable clamping arrangement can be produced in a technically simple manner through the fact that the base has a groove with a spring ring having a slit and the housing has a complementary counter-groove, and said spring ring is radially expandable by means of a threaded pin which can be screwed into a threaded through-bore in the housing.

In order to ensure that the slit in the spring ring is always positioned in the region of the threaded pin, a positioning pin for the spring ring is advantageously disposed in the groove.

The fitting of the water-conducting lines is markedly simplified in a further advantageous form of embodiment, in which the base has at least one connecting element for water-conducting lines.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplified embodiment of the invention will be explained in greater detail below with the aid of the drawings, in which.

DETAILED DESCRIPTION OF THE PRESENT INVENTION

Figure 1:
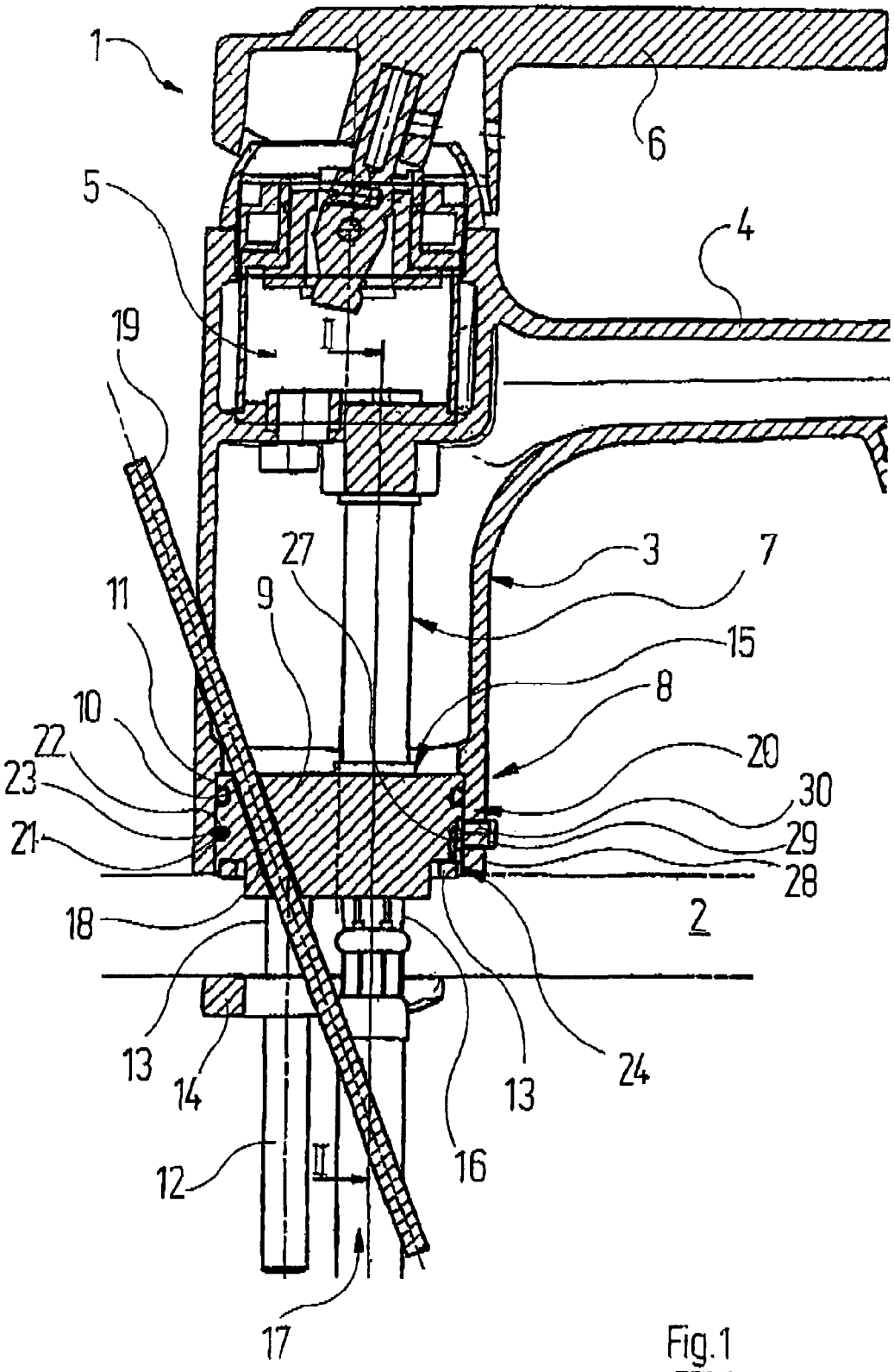
FIG. 1 shows, diagrammatically, an axial section through a washstand fitting mounted on a washstand.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

A washstand fitting 1, which is fastened to a washstand 2 from above, is represented in FIG. 1.

Said washstand fitting 1 comprises a housing 3, from which a water outlet 4 leads out at the top right-hand side in FIG. 1. Disposed in the housing 3, at the top, is a cartridge 5 which is known per se and which can be actuated by means of a mixer lever 6.

In the interior of the housing 3, two upper water-infeed lines 7 lead to the cartridge 5 from below.

In its lower region, which forms a fastening arrangement 8 as well, the housing 3 has substantially the shape of a circular hollow cylinder. It is slipped onto a base 9 which is likewise in the shape of a circular cylinder and the external cross-section of which is complementary to the internal cross-section of the lower region of the housing 3. Along the upper region of the superficies of the base 9, an O-ring 10 is disposed in a groove 11 for sealing purposes.

The base 9 is fastened on the upper side of the washstand 2 by means of a base bolt 12 which has an external thread. A plain washer 13 is disposed between the base 9 and the washstand 2.

On the left in FIG. 1, the base bolt 12 leads perpendicularly out of the lower end face of the base 9. The bolt is slipped through a through-aperture for said bolt in the washstand 2 and is secured from below by means of a clamping washer 14 and a nut which is not represented.

Figure 2:
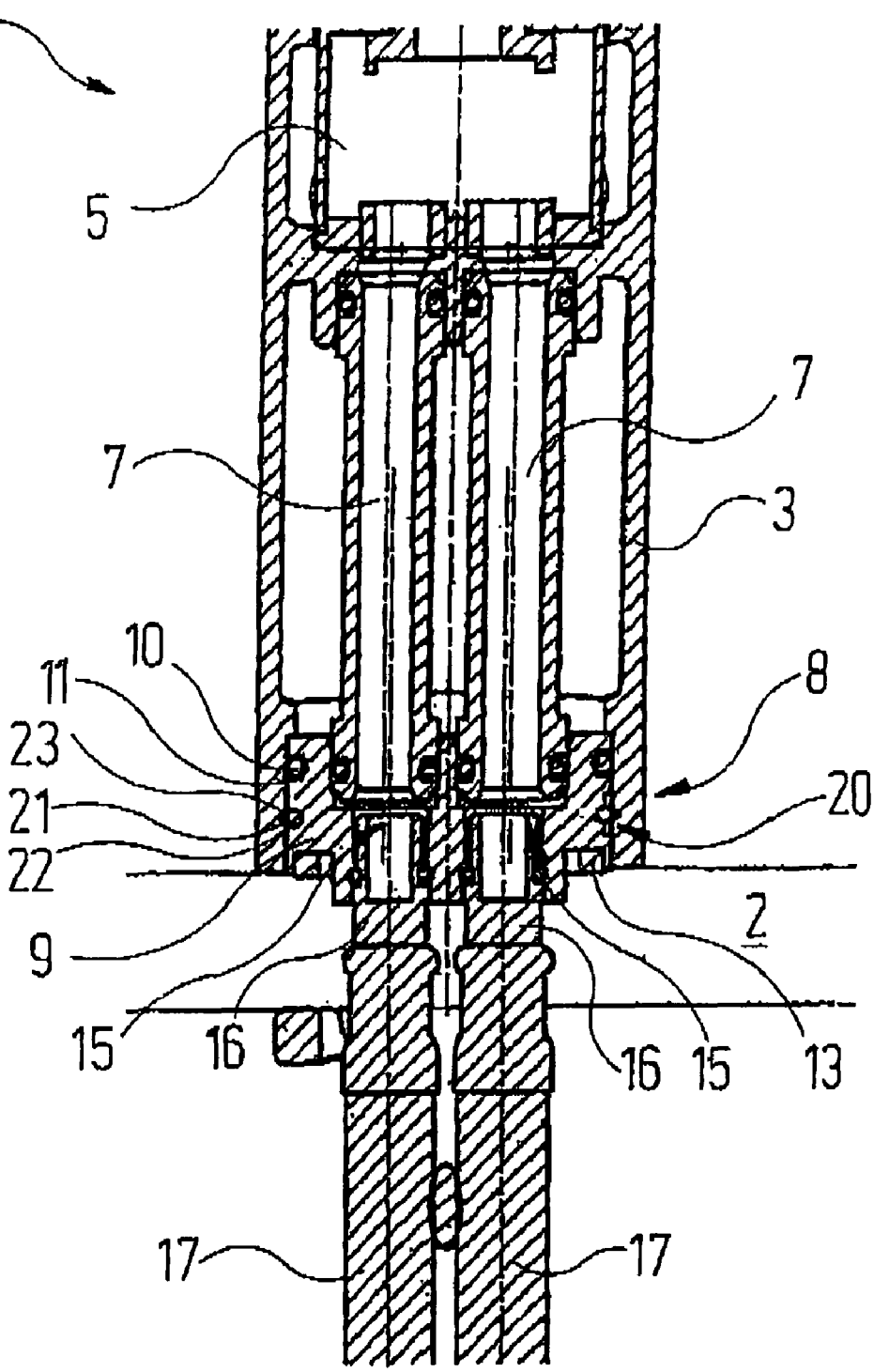
FIG. 2 shows, diagrammatically, a section through the washstand fitting represented in FIG. 1, along the line II-II therein.

In the front view in FIG. 2, there are additionally disposed in the base 9 two connecting elements 15, which are known per se, for connecting the upper water-infeed lines 7 to two lower water-infeed lines 17 which run through corresponding apertures 16 in the washstand 2 from below.

The base 9 also has a through-aperture 18 for a pull rod 19 for a waste fitting which is not represented.

In order to fix the housing 3 on the base 9, a clamping arrangement 20 is provided as an additional part of the fastening arrangement 8. Said fastening arrangement comprises a spring ring 21 which is disposed in a spring-ring groove 22 running round within the jacket of the base 9.

In the untensioned state, the spring ring 21 disappears almost completely within the spring-ring groove 22 and does not project, or projects only slightly, beyond the jacket of the base 9 (FIGS. 3 to 6). Disposed in the internal superficies of the housing 3 at the level of the spring-ring groove 22 is a counter-groove 23 which has a V-shaped cross-section and into which the spring ring 21 is partially pushed later on when in the tensioned state (FIGS. 7 to 10).

Figure 3:
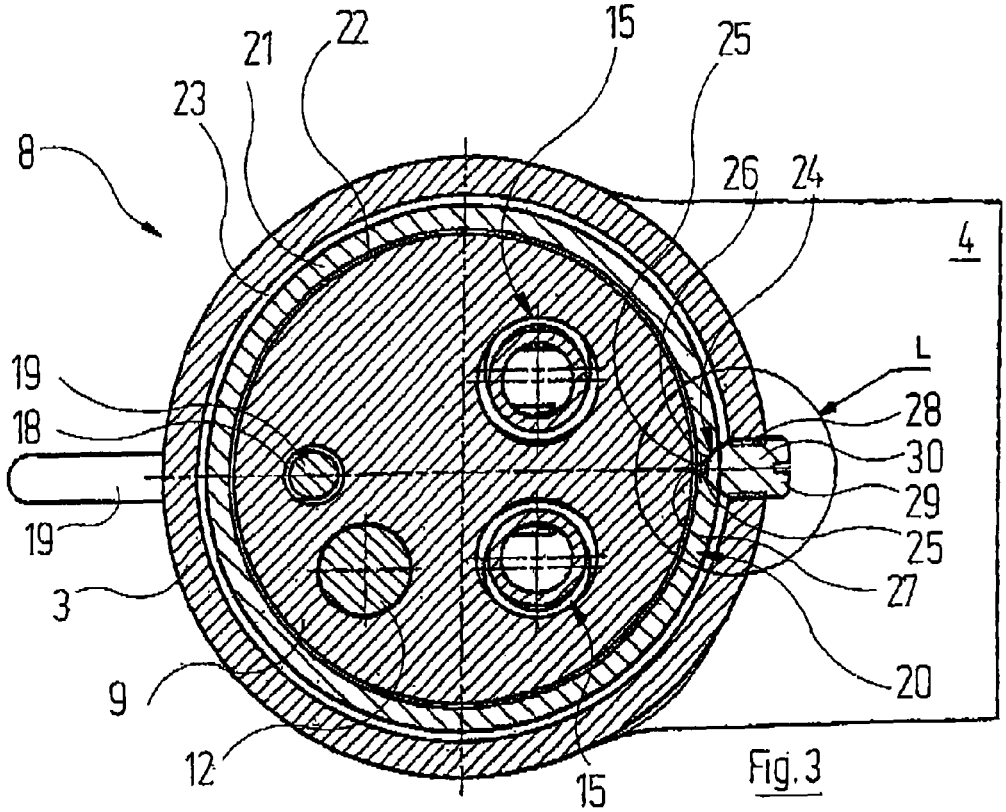
FIG. 3 shows, diagrammatically, an enlarged horizontal section through the washstand fitting represented in FIG. 1, in the region of a clamping arrangement which is shown in untensioned form here, and along the line III-III in FIG. 4.
Figure 4:
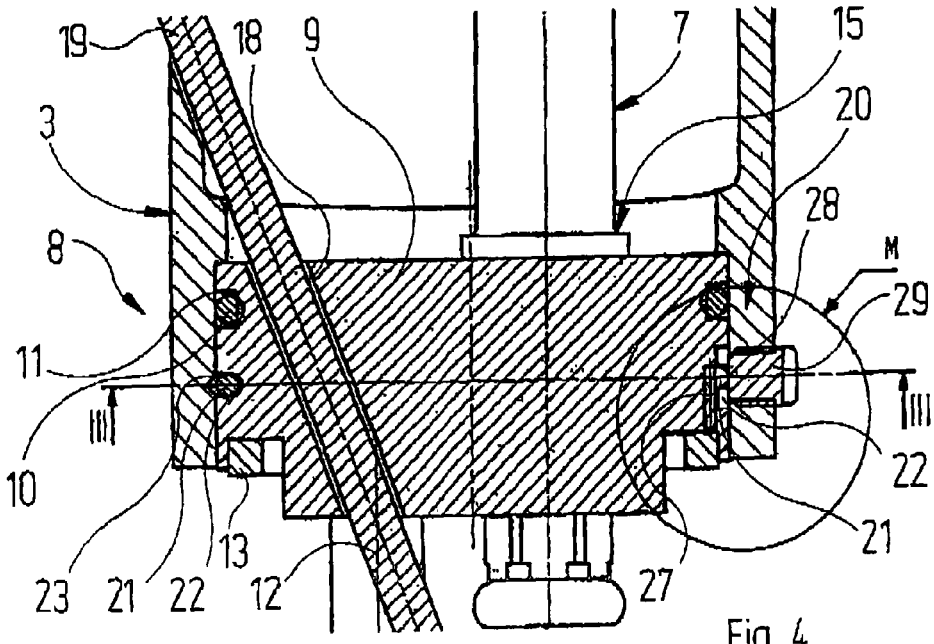
FIG. 4 shows an enlargement of a detail from FIG. 1.
Figure 5:
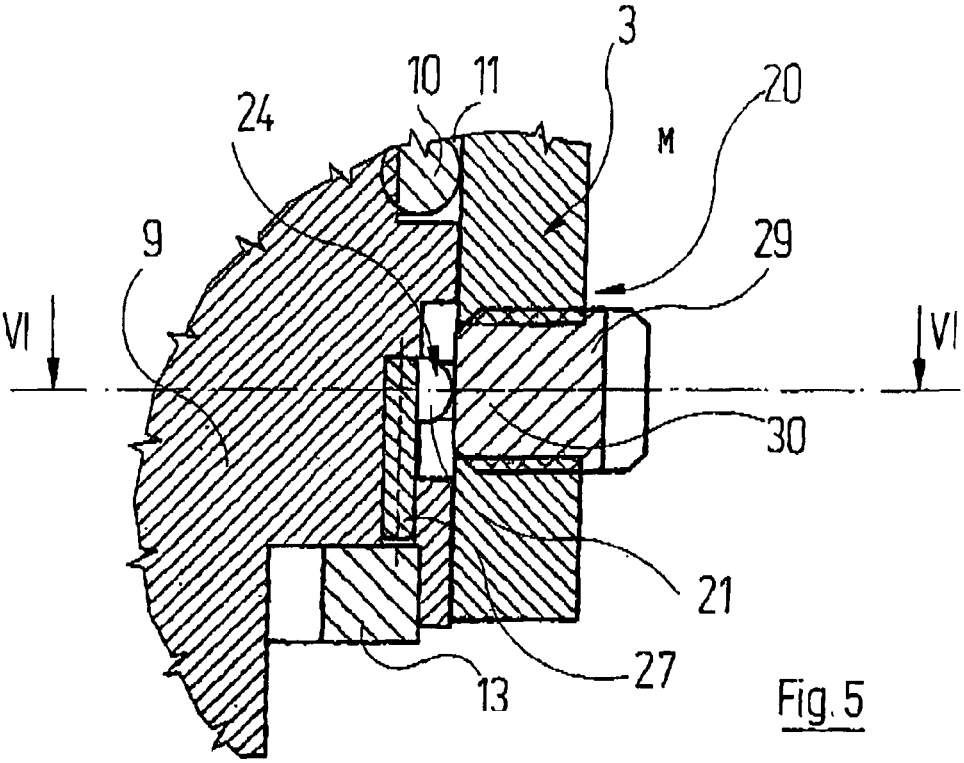
FIG. 5 shows a further enlarged detail view of the clamping arrangement represented in FIG. 4, in the region of an adjusting element.

Said spring ring 21 is slit on its side which is on the right in FIG. 3. The slit 24 in the spring ring 21 is represented in the detail in FIG. 6. In their quarter which is on the left in FIG. 6, the opposing end faces of the spring ring 21 have two mutually parallel flat faces 25. To the right of said flat faces 25, the end faces are each beveled by 45°, so that the slit 24 has, as a whole, a 90° indentation 26.

When the spring ring 21 is in the untensioned state, the flat faces 25 rest against a positioning pin 27. The positioning pin 27 is disposed in that wall of the spring-ring groove 22 which is the lower wall in FIG. 5, and said pin prevents the spring ring 21 from twisting within the spring-ring groove 22.

Figure 6:
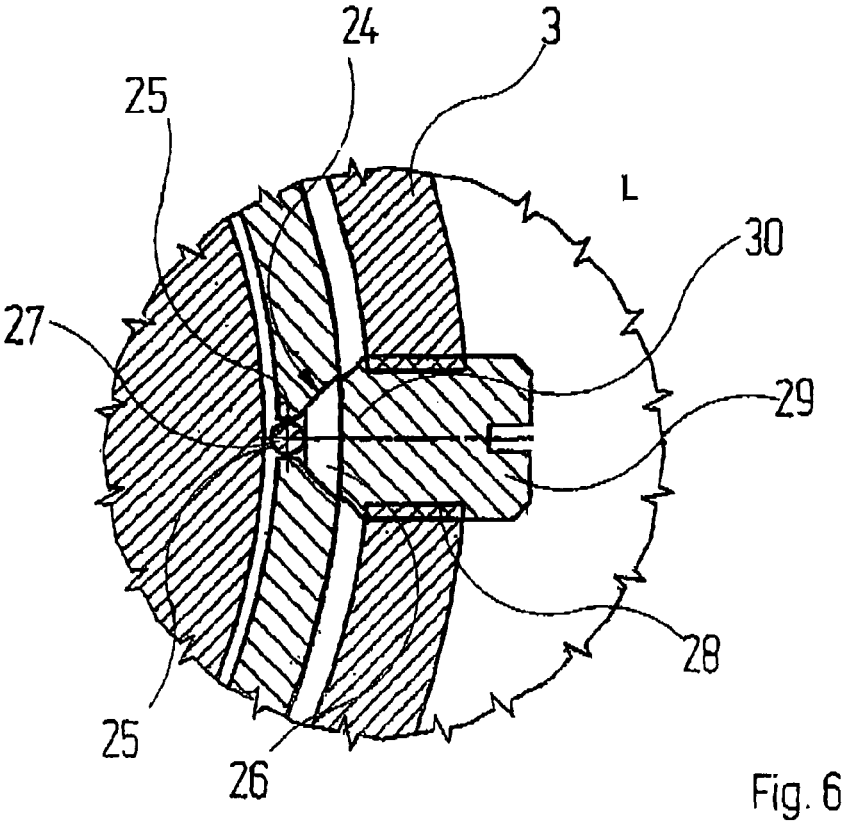
FIG. 6 shows a horizontal section through FIG. 5, along the line VI-VI therein.

In a prolongation, towards the right in the detail view in FIG. 6, in relation to the slit 24 in the spring ring 21, the jacket of the housing 3 has a threaded through-bore 28 into which a threaded pin 29 is screwed as an adjusting element for the spring ring 21. The left-hand edge of the threaded pin 29, which edge faces towards the spring ring 21, is chamfered by 45°, thus producing a truncated cone 30 with a cone angle of 90°, which is complementary to the 90° indentation 26 in the slit 24 in the spring ring 21.

Figure 7:
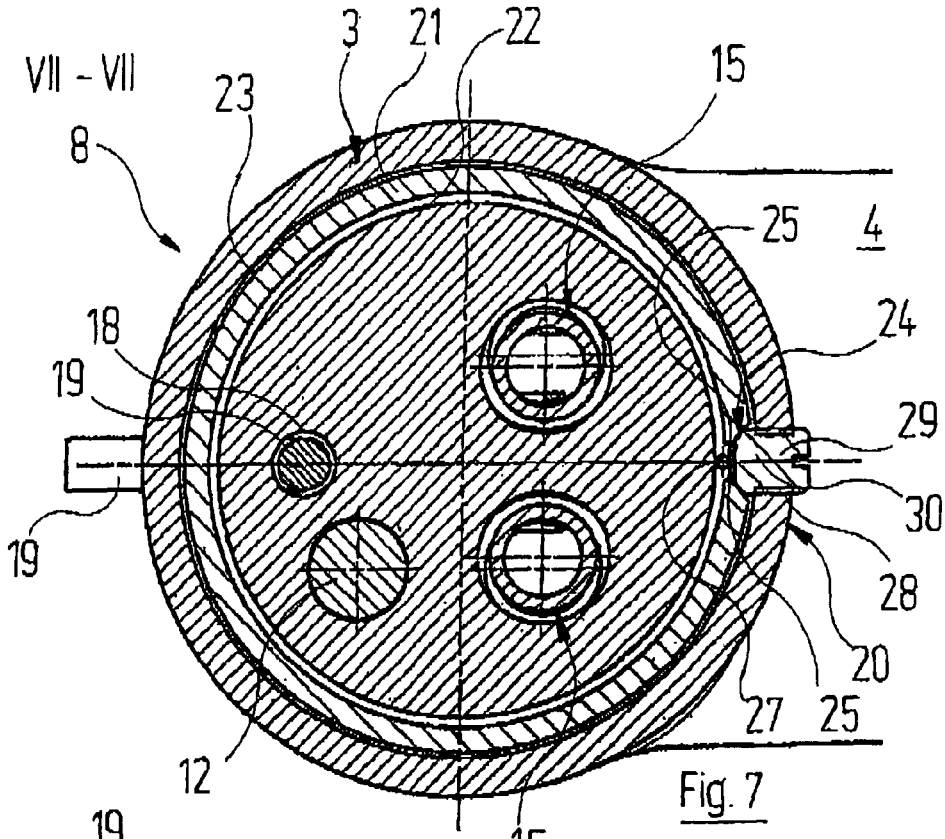
FIG. 7 shows, diagrammatically, an enlarged horizontal section through the washstand fitting represented in FIG. 1, in a manner similar to FIG. 3 but with the clamping arrangement shown in tensioned form.
Figure 8:
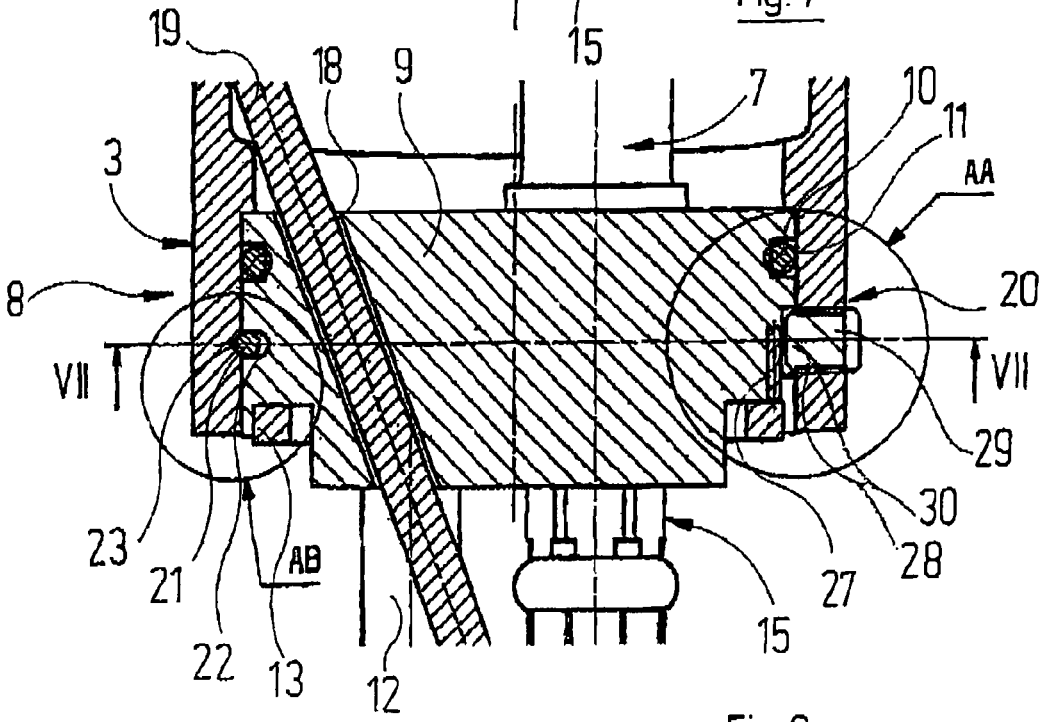
FIG. 8 shows, diagrammatically, a view similar to FIG. 4, with the clamping arrangement tensioned.
Figure 9:
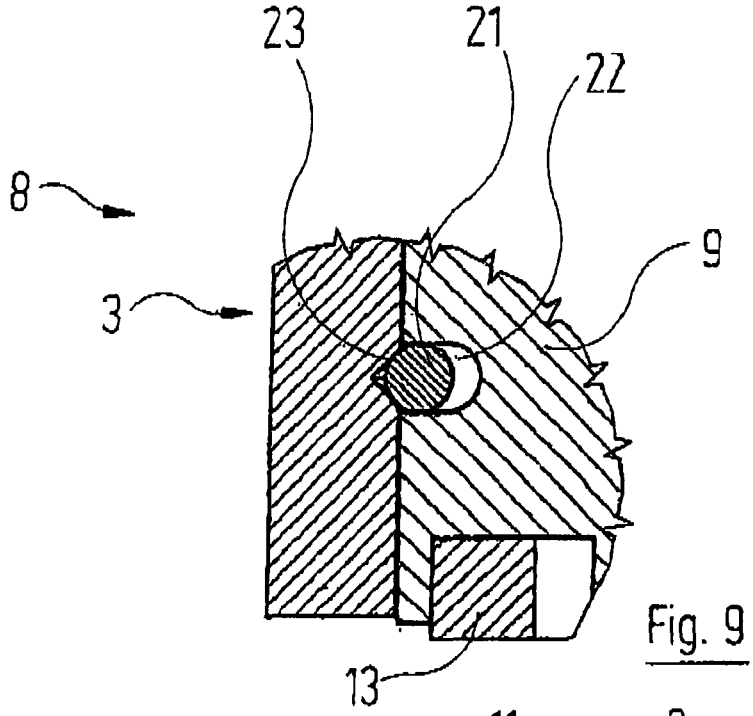
FIG. 9 shows a further enlarged detail view from FIG. 8, in the region of a spring ring.
Figure 10:
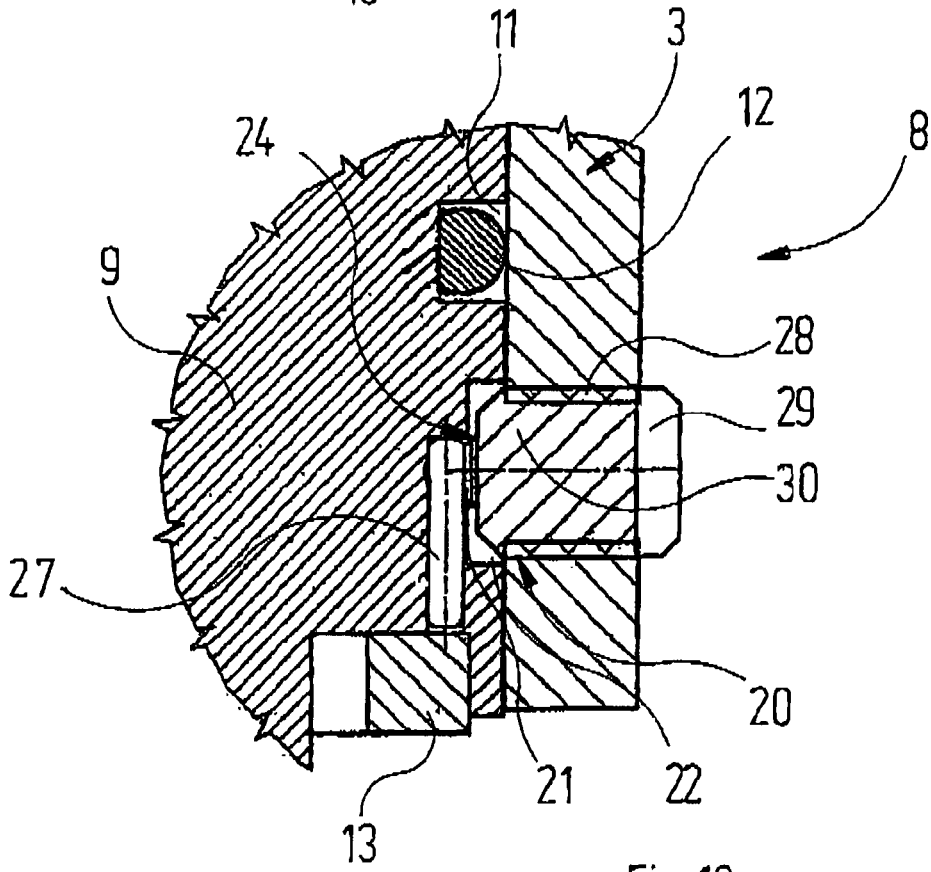
FIG. 10 shows a detail view from FIG. 8, in the region of the adjusting element.

If the threaded pin 29 is turned in the clockwise direction, the truncated cone 30 is pushed towards the left into the 90° indentation 26, and thus forces the end faces of the spring ring 21 apart from one another in the upward and downward directions respectively in FIG. 7, as is represented in section in the detail in FIG. 10. As a result of this, the spring ring 21 is expanded radially as a whole, and is forced out of the spring-ring groove 22 and into the counter-groove 23 in the housing 3, as is shown in section in FIGS. 8 and 9.

When the spring ring 21 is in the completely tensioned state, it engages, in the detail view in FIG. 9, in the counter-groove 23 with its left-hand outer third, and its inner region, which faces towards the base 9 and is on the right in FIG. 9, remains in the spring-ring groove 22, so that the base 9 is clamped in, relative to the housing 3.

In order to mount the washstand fitting 1, the base 9 is first of all fastened to the washstand 2 by means of the base bolt 12 and the connecting elements 16 are connected to the lower water-infeed lines 17 from below in FIG. 1. The threaded pin 29 is then turned anticlockwise out of the threaded bore in the jacket of the housing 3 until it no longer projects beyond the inner superficies of the latter. Said housing 3 is thereupon slipped onto the base 9 from above in FIG. 1, the upper water-infeed lines 7 being connected to the connecting elements 16 at the same time. After that, the threaded pin 29 is turned in the clockwise direction until the spring ring 21 is completely tensioned and the housing 3 is clamped fast on the base 9. Finally, the pull rod 19 is slipped through the appropriate apertures and connected to the waste fitting in a manner which is known per se.

The base 9 can also be fastened to the washstand 2 in some other way than by means of the base bolt 12, the clamping washer 14 and the nut.

The clamping arrangement 20 may, for example, also be produced in the housing 3 by means of a large number of grub screws which are screwed into a groove in the jacket of the base 9.

The spring ring 21 may also have, for example, an angular or elliptical cross-section instead of a round one.

Instead of the threaded pin 29 with the truncated cone 30, use may also be made of a pin with a non-circular, in particular elliptical, cross-section, by means of which, as a result of rotation, the end faces of the aperture 24 in the spring ring 21, which in this case are preferably parallel, are forced apart.

It is to be understood that additional embodiments of the high-speed door assembly described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A sanitary washstand fitting having a housing which is detachably fastened to a washstand with the aid of a fastening arrangement, the fastening arrangement comprising:

a base which can be fastened to the washstand;

a slip-on arrangement by means of which the housing can be slipped onto the base from above; and, a clamping arrangement by means of which the housing which has been slipped on can be locked against the base; and, wherein the base has a groove with a spring ring having a slit and the housing has a complementary counter-groove, and said spring ring is radially expandable by means of a threaded pin which can be screwed into a threaded through-bore in the housing.

2. The sanitary washstand fitting of claim 1, wherein the clamping arrangement comprises a clamping element which can be tensioned and untensioned, by means of an adjusting element.

3. The sanitary washstand fitting according to claim 1, wherein the base has at least one connecting element for water-conducting lines.

4. The sanitary washstand fitting of claim 3, wherein the clamping arrangement comprises a clamping element which can be tensioned and untensioned, by means of an adjusting element.

5. A sanitary washstand fitting having a housing which is detachably fastened to a washstand with the aid of a fastening arrangement, the fastening arrangement comprising:

a base which can be fastened to the washstand;

a slip-on arrangement by means of which the housing can be slipped onto the base from above; and, a clamping arrangement by means of which the housing which has been slipped on can be locked against the base; and, wherein the base has a groove with a spring ring having a slit and the housing has a complementary counter-groove, and said spring ring is radially expandable by means of a threaded pin which can be screwed into a threaded through-bore in the housing, and wherein a positioning pin for the spring ring is disposed in the groove.

6. The sanitary washstand fitting of claim 5, wherein the clamping arrangement comprises a clamping element which can be tensioned and untensioned, by means of an adjusting element.

7. A sanitary washstand fitting having a housing which is detachably fastened to a washstand with the aid of a fastening arrangement, the fastening arrangement comprising:

a base which can be fastened to the washstand and which includes at least one connecting element for water-conducting lines;

a slip-on arrangement by means of which the housing can be slipped onto the base from above; and, a clamping arrangement by means of which the housing which has been slipped on can be locked against the base; and, wherein the base has a groove with a spring ring having a slit and the housing has a complementary counter-groove, and said spring ring is radially expandable by means of a threaded pin which can be screwed into a threaded through-bore in the housing, and wherein a positioning pin for the spring ring is disposed in the groove.

8. The sanitary washstand fitting of claim 7, wherein the clamping arrangement comprises a clamping element which can be tensioned and untensioned, by means of an adjusting element.

* * * * *